US009750124B2

(12) United States Patent
Kemp et al.

(10) Patent No.: US 9,750,124 B2
(45) Date of Patent: Aug. 29, 2017

(54) PIEZOELECTRIC PARTICLE ACCELERATOR

(71) Applicant: The Board of Trustees of the Leland Stanford Junior University, Palo Alto, CA (US)

(72) Inventors: Mark A. Kemp, Belmont, CA (US); Erik N. Jongewaard, Sunnyvale, CA (US); Andrew A. Haase, Belmont, CA (US); Matthew Franzi, Burlingame, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 15/082,347

(22) Filed: Mar. 28, 2016

(65) Prior Publication Data

US 2016/0338186 A1 Nov. 17, 2016

Related U.S. Application Data

(60) Provisional application No. 62/142,810, filed on Apr. 3, 2015.

(51) Int. Cl.
*H05H 15/00* (2006.01)

(52) U.S. Cl.
CPC ..... *H05H 15/00* (2013.01)

(58) Field of Classification Search
None
See application file for complete search history.

(56) References Cited

U.S. PATENT DOCUMENTS 3,311,873 A * 3/1967 Schloss ..... G01V 1/189 310/328
4,520,674 A * 6/1985 Canada ..... G01H 1/00 702/197
5,039,170 A * 8/1991 Sudano, Jr. ..... B25D 17/24 173/210
5,229,680 A 7/1993 Sato et al.
5,231,879 A * 8/1993 Yamamoto ..... G01P 15/12 257/414
5,574,220 A * 11/1996 Amand ..... G01L 1/162 310/321

(Continued)

FOREIGN PATENT DOCUMENTS

DE WO 2008064802 A3 * 4/2009 ..... F16C 32/0442
WO WO2015047473 A3 10/2015

*Primary Examiner* — Douglas W Owens
*Assistant Examiner* — Srinivas Sathiraju
(74) *Attorney, Agent, or Firm* — Lumen Patent Firm

(57) ABSTRACT

A particle accelerator is provided that includes a piezoelectric accelerator element, where the piezoelectric accelerator element includes a hollow cylindrical shape, and an input transducer, where the input transducer is disposed to provide an input signal to the piezoelectric accelerator element, where the input signal induces a mechanical excitation of the piezoelectric accelerator element, where the mechanical excitation is capable of generating a piezoelectric electric field proximal to an axis of the cylindrical shape, where the piezoelectric accelerator is configured to accelerate a charged particle longitudinally along the axis of the cylindrical shape according to the piezoelectric electric field.

15 Claims, 7 Drawing Sheets

(56) References Cited

U.S. PATENT DOCUMENTS 5,675,208 A * 10/1997 Huang ..... H01L 41/107 310/320
5,757,106 A * 5/1998 Sato ..... H01L 41/107 310/359
5,763,983 A * 6/1998 Huang ..... H01L 41/107 310/358
5,969,462 A * 10/1999 Huang ..... H01L 41/107 310/318
6,172,446 B1 * 1/2001 Kanayama ..... H01L 41/053 310/348
6,181,073 B1 * 1/2001 Branham ..... H05B 41/24 315/209 PZ
6,342,753 B1 * 1/2002 Oliver ..... H03H 9/0222 310/359
6,553,958 B1 * 4/2003 Kolmanovsky ..... F02B 17/005 123/295
6,911,765 B2 * 6/2005 Kawashima ..... H03H 9/02023 310/370
7,168,321 B2 * 1/2007 Terada ..... B81B 3/0051 310/321
7,205,708 B2 * 4/2007 Yamada ..... H03H 9/21 310/370
7,444,883 B2 * 11/2008 Novack ..... G01L 1/106 73/826
7,456,708 B2 * 11/2008 Chou ..... H01L 41/107 310/357
7,619,349 B2 * 11/2009 Kawakubo ..... H01G 5/16 310/328
RE41,671 E * 9/2010 Kawashima ..... H03H 9/02023 310/370
8,396,181 B2 * 3/2013 Naranjo ..... 376/100
8,446,079 B2 * 5/2013 Fang ..... H03H 9/21 310/370
2008/0142717 A1 * 6/2008 Naranjo ..... G21B 3/006 250/341.2
2009/0046823 A1 * 2/2009 Edwards ..... H05H 3/06 376/114

* cited by examiner

PIEZOELECTRIC PARTICLE ACCELERATOR

CROSS-REFERENCE TO RELATED APPLICATIONS

This application claims priority from U.S. Provisional Patent Application 62/142,810 filed Apr. 3, 2015, which is incorporated herein by reference.

STATEMENT OF GOVERNMENT SPONSORED SUPPORT

This invention was made with Government support under contract HR0011515265 awarded by the Defense Advanced Research Projects Agency, and under contract DE-AC02-76SF00515 awarded by the Department of Energy. The Government has certain rights in the invention.

FIELD OF THE INVENTION

The invention relates generally to particle accelerators. More specifically, the invention relates to a piezoelectric accelerator for charged particles.

BACKGROUND OF THE INVENTION

A neutron source typically relies on collisions between accelerated charged particles and a target to provide neutrons. X-ray sources also tend to have this configuration, where the relevant charged particles are electrons. In either case, the required particle accelerator can be the most large, complex and costly part of the neutron source (or X-ray source). Accordingly, it would be an advance in the art to provide a smaller and simpler particle accelerator.

SUMMARY OF THE INVENTION

To address the needs in the art, a particle accelerator is provided that includes a piezoelectric accelerator element, where the piezoelectric accelerator element includes a hollow cylindrical shape, and an input transducer, where the input transducer is disposed to provide an input signal to the piezoelectric accelerator element, where the input signal induces a mechanical excitation of the piezoelectric accelerator element, where the mechanical excitation is capable of generating a piezoelectric electric field proximal to an axis of the cylindrical shape, where the piezoelectric accelerator is configured to accelerate a charged particle longitudinally along the axis of the cylindrical shape according to the piezoelectric electric field.

According to one aspect of the invention, the piezoelectric accelerator element is a material that includes Lithium Niobate, Lithium Tantalate, Quartz, or Lead Zirconate Titanate.

In another aspect of the invention, the piezoelectric accelerator element includes a plurality of the hollow tubes, where the plurality of hollow tubes are configured in an arrangement that includes a monolithic, single hollow tube, a series connection of hollow tubes, a concentric arrangement of nested hollow tubes, or a concentric arrangement of solid rods.

According to one aspect of the invention, the input transducer includes a piezoelectric disk disposed on one end of the piezoelectric accelerator element, where the piezoelectric disk is disposed to impart a displacement onto the piezoelectric tube, where the displacement is capable of exciting a first extensional vibration mode of the piezoelectric accelerator element, where a stress in the material of the piezoelectric accelerator element induces an electric field that is disposed to electrostatically accelerate a charged particle. In one aspect, the displacement includes a CW sinusoidal displacement. In a further aspect, the CW sinusoidal displacement is in a range of 1-20 μm. In another aspect, the induced electric field has a field strength in a range of 0 to 4 MV/m. According to one aspect, the invention includes a target mounted at the end of the piezoelectric accelerator element, where the charged particle is electrostatically accelerated by the electric field until impacting the target mounted at the end of the piezoelectric accelerator element.

According to another aspect of the invention, the charged particle includes protons, deuterium ions, tritium ions, electrons, or charged particles that are heavier than the electrons.

In yet another aspect of the invention, the electric field lines are proximally parallel with the axis of the hollow tube, where an injected beam is accelerated down the hollow tube.

According to one aspect of the invention, the piezoelectric accelerating element is disposed to operate in a bipolar mode or a single polarity mode.

In another aspect of the invention, an end of the piezoelectric accelerator is mass loaded, where the mass loading is disposed to equalize the stress in the hallow tube to increase an effective gradient.

In a further aspect of the invention, a target or an ion source is at ground or high voltage.

DETAILED DESCRIPTION

Figure 1:
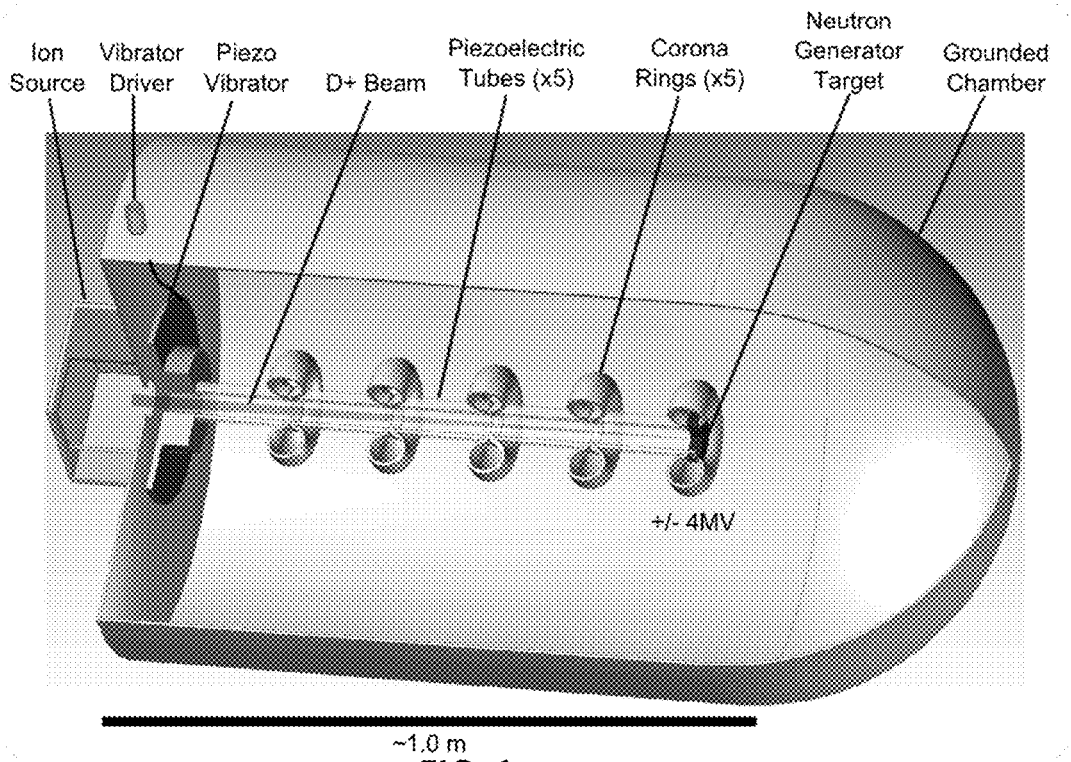
FIG. 1 shows a beam axially injected down center of a tube, where the beam is accelerated as it passes axially down the center of the tube, according to one embodiment of the invention.

The current invention provides a piezoelectric accelerator for charged particles. In one embodiment, a combination of an ion source and a deuterated target with the piezoelectric accelerator provides a compact neutron generator system. In a further embodiment, a combination of an electron source and a suitable X-ray target with the piezoelectric accelerator provides a compact X-ray source.

According to one embodiment of the invention, a piezoelectric accelerating structure is provided for use in a portable neutron generator system. This system includes a low voltage AC power source, a piezoelectric vibration source, and an electrostatic piezoelectric accelerator.

In a further embodiment, deuterium ions or electrons (for use in, say, X-ray production) can be accelerated. The final energy of the particles is equal to the potential difference over the length of the piezoelectric column. A gated particle source ensures neutron production only occurs when the potential is above a desired threshold. This approach could also be used to provide a portable, low-cost x-ray source.

The current invention provides cylindrical piezoelectric crystal geometry to accelerate particles. From this, the geometry has ideal alignment of the electric field from the source to the target, where no confining magnetic field is required, and all the injected particles are accelerated.

In a Rosen-type device construction, approximately half of the transformer is at or near ground potential. According to one embodiment of the current invention, through the use of crystal-crystal bonding, a more-compact configuration of a series of tubes, rather than the Rosen-type, is provided, where a separate vibration source is configured to induce the extensional vibration mode in the piezoelectric tube.

There are many applications for the piezoelectric accelerator neutron source embodiment. Thermal neutron radiography is a non-destructive inspection technique, which interrogates materials via interactions with elements such as hydrogen or boron. Further applications include imaging corrosion in aircraft structures, detecting explosive charges, and locating faulty connections in electronics. Fast neutron radiography can inspect light materials within a dense outer casing. Neutron activation analysis can be used to assay nuclear fuel assemblies or detect gold in bore-hole cores. Finally, there is a growing application of thermal neutrons for medical therapy and imaging. The accelerator can be used for active interrogation purposes, since the accelerator will produce up to 7 MeV neutrons that could then produce in-elastically scattered gamma lines from Carbon, Nitrogen, and Oxygen. These lines allow for determining if explosives are in the scanned package or cargo. Additionally, the use of neutrons allow the package or cargo to be scanned for fissile or fertile nuclear materials, and also allow neutron radiography of thick packages or cargos. In a highly portable format, there are multiple applications in the homeland security and counter-terrorism space. For example it could be used in a port for scanning cargo, or it could be used in the field by for military counter-terrorism operations.

In one exemplary embodiment, Lithium Niobate (LN, or $LiNbO_3$) is used as the piezoelectric material for its high mechanical strength, piezoelectric constant, dielectric strength, and mechanical quality factor.

Turning now to the figures, FIG. 1 shows one embodiment of the current invention, where the beam is axially injected down center of single or set of tubes. Here, the beam is accelerated as it passes axially down the center of the tubes, rather than from the high voltage source of a separate device. Here, a multi-function piezoelectric material provides the structural support, insulation, and high-voltage generation for the electrostatic accelerator. This unique geometry and two-element piezoelectric transformer yields a dramatic size, weight, and power improvement over what is known in the art.

In one aspect, the piezoelectric accelerator element includes a plurality of hollow tubes that are configured in an arrangement that can include a monolithic, single hollow tube, a series connection of hollow tubes, a concentric arrangement of nested hollow tubes, and a concentric arrangement of solid rods. In the last case, the geometrical effect of a hollow tube can be approximated by a number of rods evenly placed around the azimuths of a circle with the same diameter as the hollow tube, which is being approximated.

Figure 2:
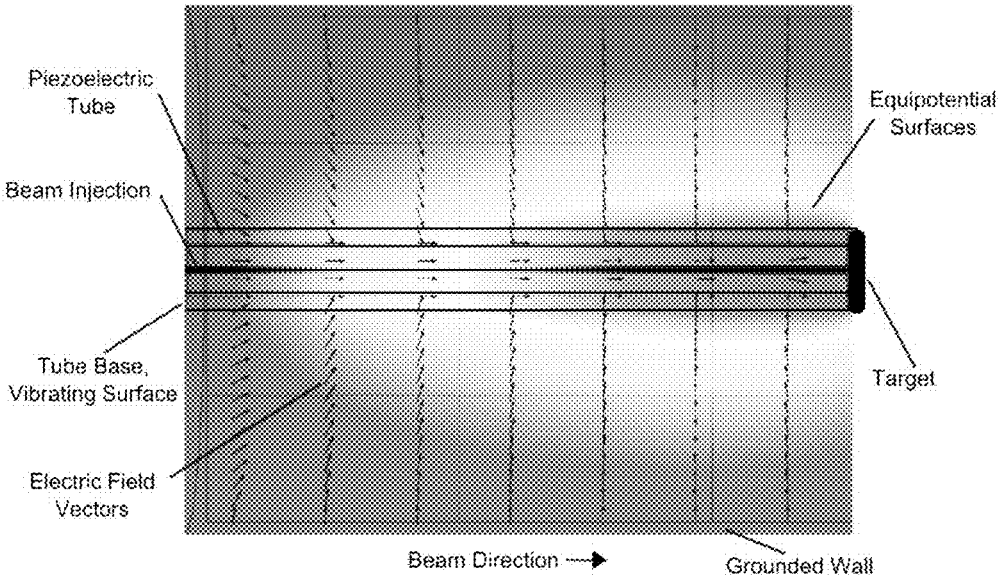
FIG. 2 shows a multi-physics COMSOL simulation of a piezoelectric crystal tube accelerating a deuterium beam, where represented are both the equipotential surfaces as well as the kinetic energy of the injected beam, according to one embodiment of the invention.
Figure 3E:
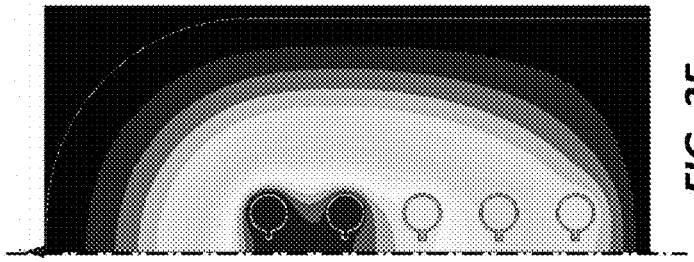
FIGS. 3A-3E show Maxwell simulation of corona rings and electrostatic shields used to shape the electric fields in the chamber, where (3A) shows a simulated structure, (3B) shows the electric field magnitude with shield, (3C) shows the electric potential lines with shield, (3D) shows electric field magnitude without shield, (3E) shows the equipotential lines without shield, and shown is a 2 MeV (0.5 m long) accelerator, according to one embodiment of the invention.
Figure 3D:
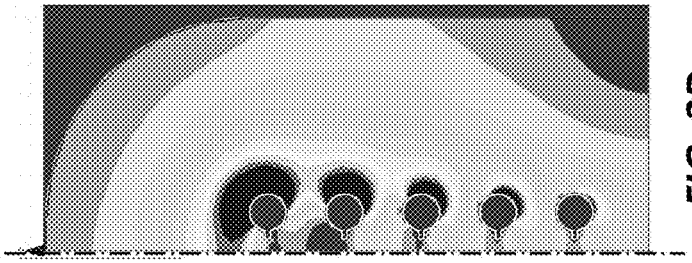
Figure 3C:
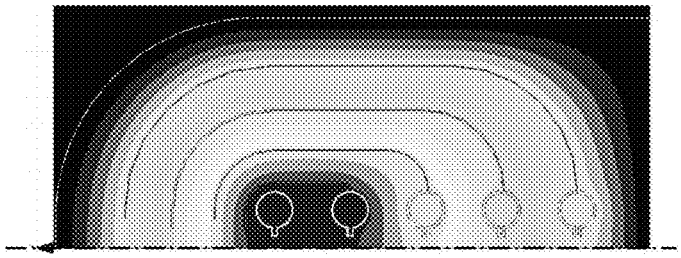
Figure 3B:
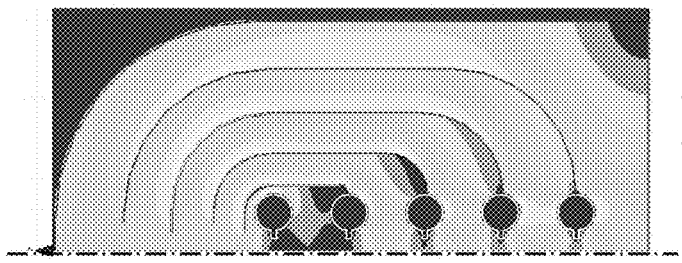
Figure 3A:
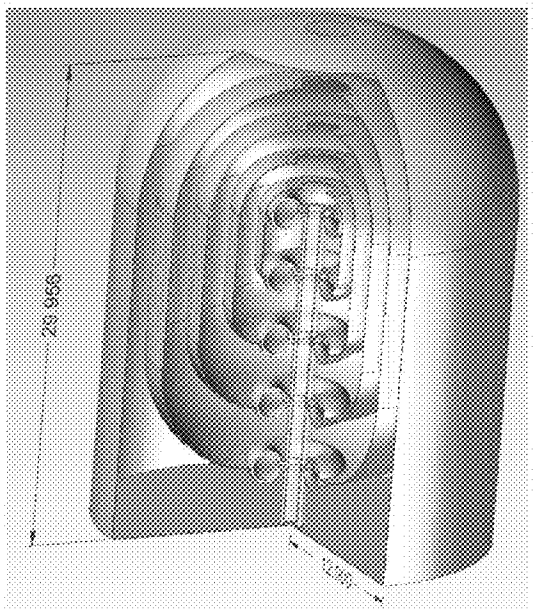

According to one embodiment, the electric field lines are primarily parallel with the axis of the cylinder to ensure the entire injected beam is accelerated down the tube, as shown in FIG. 2. In the previous art, unless complex field shapers are used, much of the beam is not productively accelerated, reducing system efficiency. As shown in FIG. 2, the electric field vectors are parallel to the axis of the tube. With the piezoelectric-generated fields present, to represent a pulsed current source, for example a 1 keV, 500 μA deuterium beam is injected into the tube. The beam remains confined due to the small space-charge forces and is accelerated to the end of the tube. Note that all of the beam is accelerated and is mono-energetic, which is a significant advancement over what is known in the art of piezoelectric-based particle acceleration.

Another advantage of the proposed geometry is the low resonant frequency. For a simplified case, constant average stress ($T_{avg}$), piezoelectric voltage constant ($g_{33}$), and frequency constant (N), the maximum induced voltage ($V_{out}$) is inversely proportional to the resonant frequency (ƒ), $$V_{out} = \frac{T_{avg} g_{33} N}{2f}. \tag{1}$$

Also, the mechanical loss ($P_{DM}$) in the piezoelectric scales as $f^3$ as shown in $$P_{DM} = \frac{V_{out}^2 4\pi f^3}{g_{33}^2 L^2 Y Q_m}. \tag{2}$$

Equation (2) also illustrates that a high mechanical quality factor ($Q_m$) increases system efficiency. It is for this reason that $LiNbO_3$ ($Q_m$~10,000) is initially considered instead of the more-common PZT ($Q_m$~500). Additional $LiNbO_3$ advantages include a high dielectric breakdown strength (>10 kV/mm) and a high Curie temperate (>1000° C.). The low vibration frequency is achieved by using long, bonded piezoelectric elements.

There are several effects of driving the tube near the extensional resonance. First, the effective "transformer ratio" near resonance is higher than off-resonance. In other words, to achieve the same output voltage, a larger driving displacement is required when off-resonance. Near resonance, a smaller vibration driver may be used (say, +/−5 μm could be used rather than +/−15 μm). On the other hand, the elastic losses increase near resonance. Hence, an important the metric is output voltage per power dissipation (V/W), where a higher voltage can be obtained for the same amount of power dissipation.

A pressurized gas such as SF6 may be used in a grounded chamber. Vacuum could also be used, however, the piezoelectric and target need to be cooled. Utilization of gas insulation opens up the possibility of using gas jets for targeted cooling.

FIGS. 3A-3E show one embodiment configured to maximize the use of space within the chamber. Equipotential shields reduce the peak electric field on the corona rings. The reduced size incorporates weighed versus electrical loading to account for stray capacitance, where mechanical mounting uses low elastic loss bonds.

Figure 4:
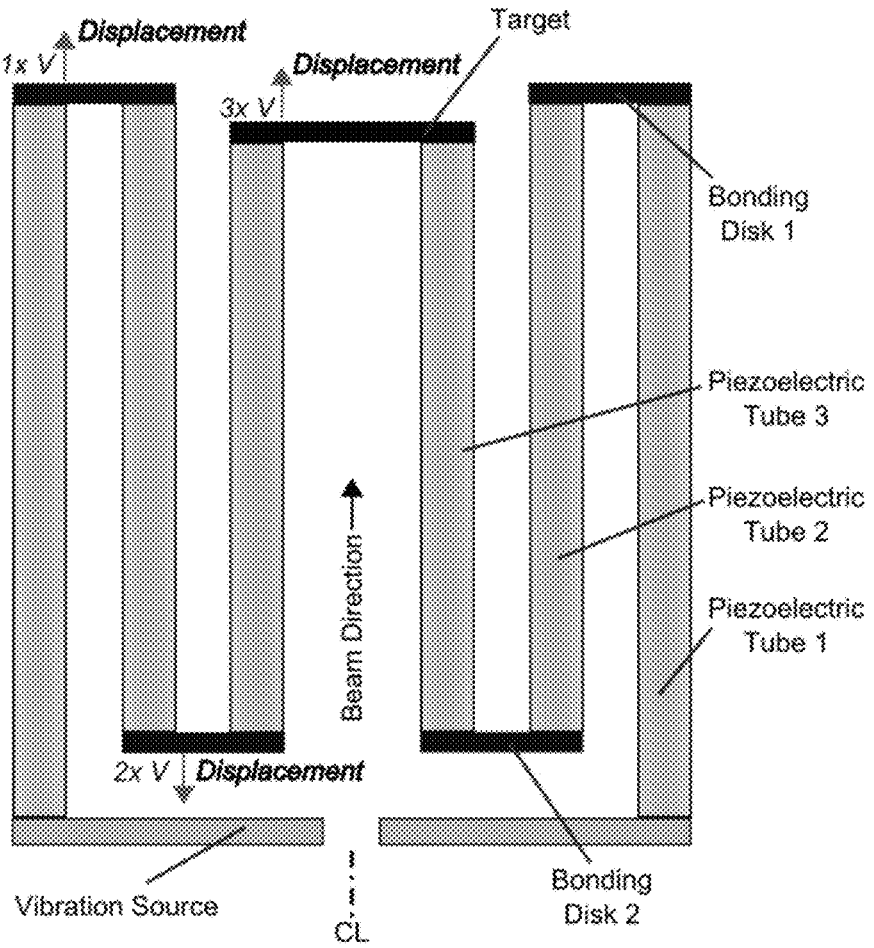
FIG. 4 shows a schematic drawing of alternative geometry using nested tubes having a vibrating source and bonding disks supporting the tubes, according to one embodiment of the invention.

Mitigation of many of the issues associated with electrical loading, peak material stress, and power dissipation may be possible by altering the baseline geometry. Instead of a series stack of tubes, alternatively, the tubes can be nested, with the high voltage tube in the innermost diameter, shown in FIG. 4. In this geometry, for a given total length, the required voltage to be produced by any one piezoelectric decreases. Therefore, the peak stress and power dissipation reduce. The peak field along the length of the cylinder decreases, reducing the probability of flashover. The outermost cylinder "shields" the high-potential inner cylinder from the grounded chamber wall.

Therefore, a much smaller distance from the piezoelectric accelerating column to the chamber wall may be possible. In effect, the piezoelectric cylinders can take the place of the equipotential shields shown in FIG. 4.

The smallest possible volume would be obtained with a stack diameter equal to the stack length. To simplify fabrication, instead of a large diameter tube, outer tubes 1 and 2 could potentially be replaced by multiple rods located at a constant radius. Note, as shown, most of the beam acceleration occurs between the vibration source and the entrance into tube 3.

In one exemplary embodiment, 4 MV/m and 1 MV is provided. For this example, a 0.25 m tube generates 1 MV. If five nested tubes each ~0.25 m long are used, the voltage across each decreases from 1 MV to 200 kV, and the peak stress decreases from 120 MPa to about 24 MPa. The average tube surface field decreases from 4 MV/m to about 0.8 MV/m, and the highest potential at the outside of the stack is about 200 kV. The overall power dissipation also decreases (see eq. (2)).

The design of such a structure is not trivial. First, the tubes must vibrate in-phase to sum potentials. Second, the bonding of the structure is more involved than the baseline design (however, metal-crystal bonds are typically simpler than crystal-crystal bonds) and requires electrically conductive, low loss disks. Third, increased numbers of tubes may increase weight. However, the embodiment is much more compact than the baseline and the $LiNbO_3$ is able to operate at a much less stressed level.

Figure 5:
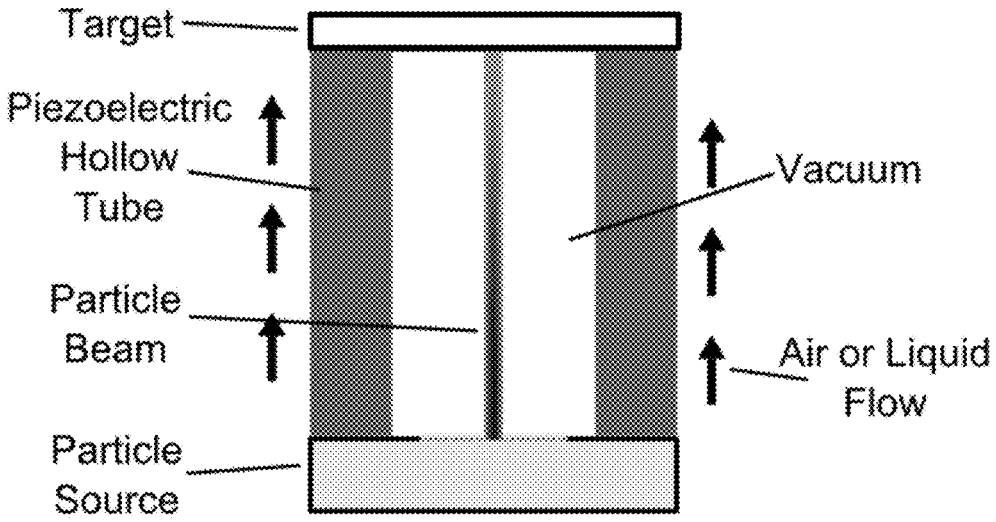
FIG. 5 shows an air-cooled particle accelerator with a vacuum inner region, according to one embodiment of the invention.

In yet another aspect of the invention, the center of the tube is in a vacuum state and the piezoelectric forms the vacuum envelope. This enables the outside of the piezoelectric to have substantial cooling by either air or liquid dielectric. Conventional devices typically require the piezoelectric to be completely in vacuum, which limits the amount of cooling that could reach the piezoelectric or target. FIG. 5 shows an air-cooled particle accelerator with a vacuum inner region, according to one embodiment of the invention.

Figure 6A:
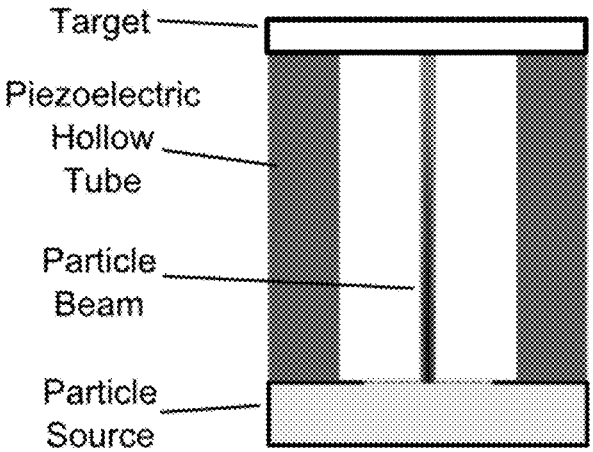
FIGS. 6A-6B show drawing of a single tube (6A) and multiple serially connected tubes (6B), according to embodiments of the current invention.
Figure 6B:
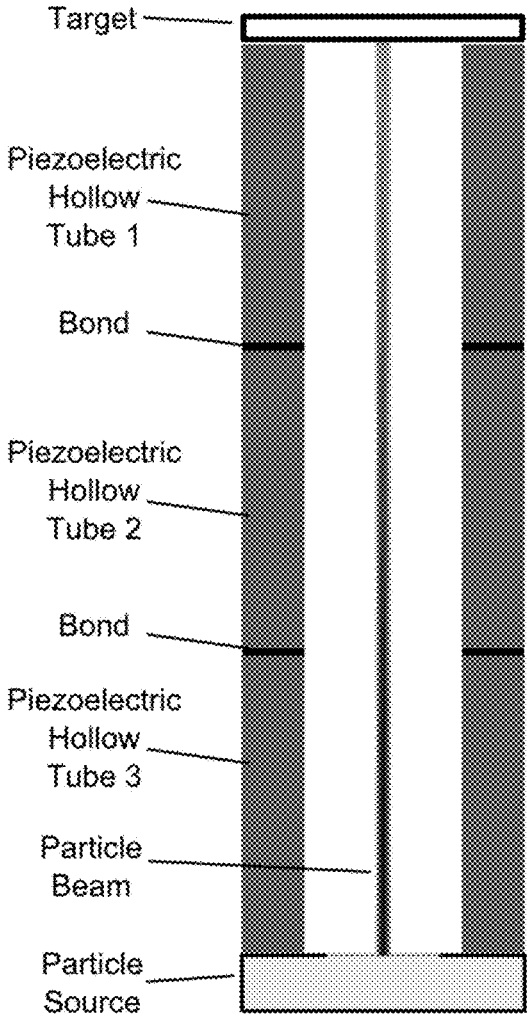

In a further embodiment, the system includes two or more tubes joined together, or a monolithic tube. Depending on the application, it may be desired to have a single, low voltage tube, or extend the device to enable high voltage operation. FIGS. 6A-6B show drawing of a single tube (6A) and multiple serially connected tubes (6B), according to embodiments of the current invention.

Figure 7A:
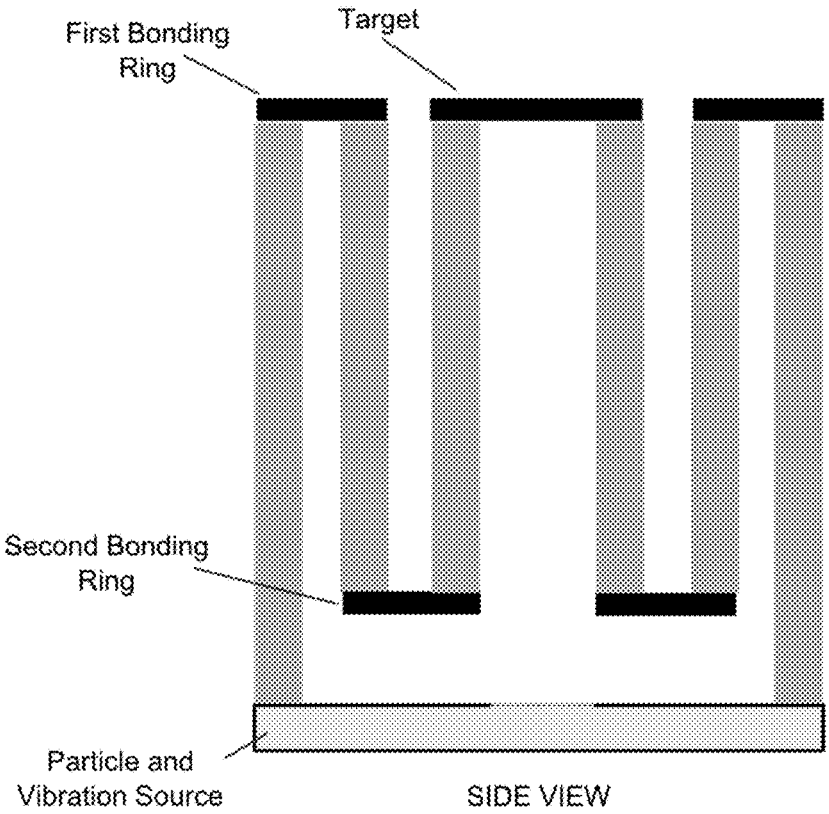
FIGS. 7A-7B shows a side view (7A) and top view (7B) of a nested series connection of rods. These rods approximate the geometry shown in FIG. 4.
Figure 7B:
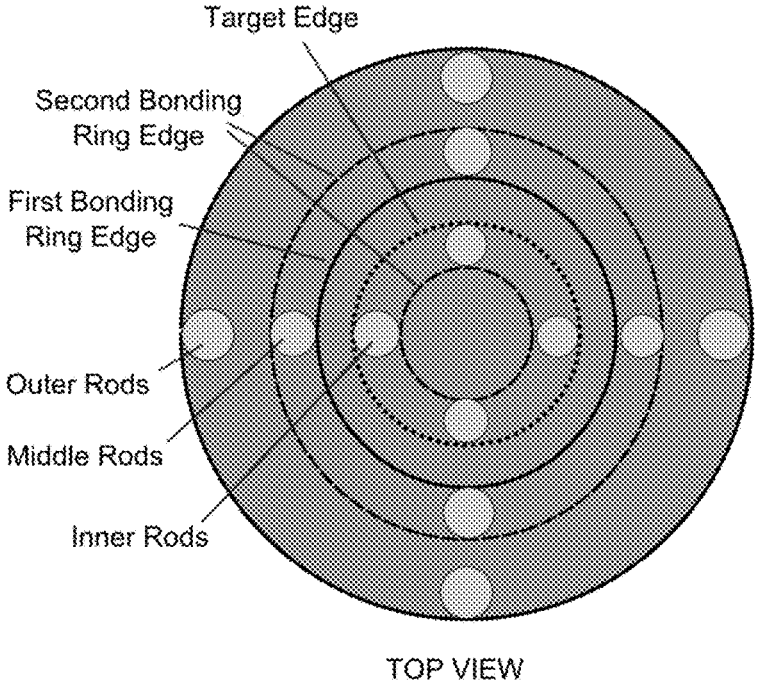

FIG. 7A shows a side view and FIG. 7A shows a top view of a nested series connection of rods. These rods approximate the geometry shown in FIG. 4.

Figure 8A:
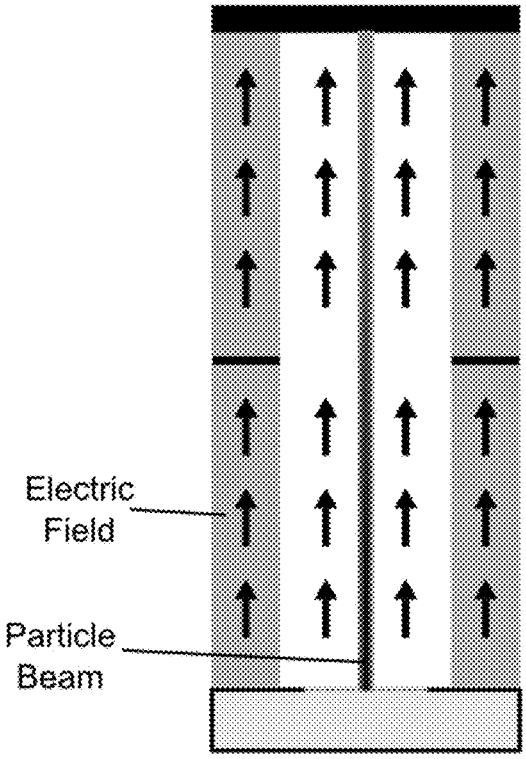
FIGS. 8A-8B show serially connected tubes having aligned crystal orientation (8A) and rotated crystal orientations (8B), according to embodiments of the invention.
Figure 8B:
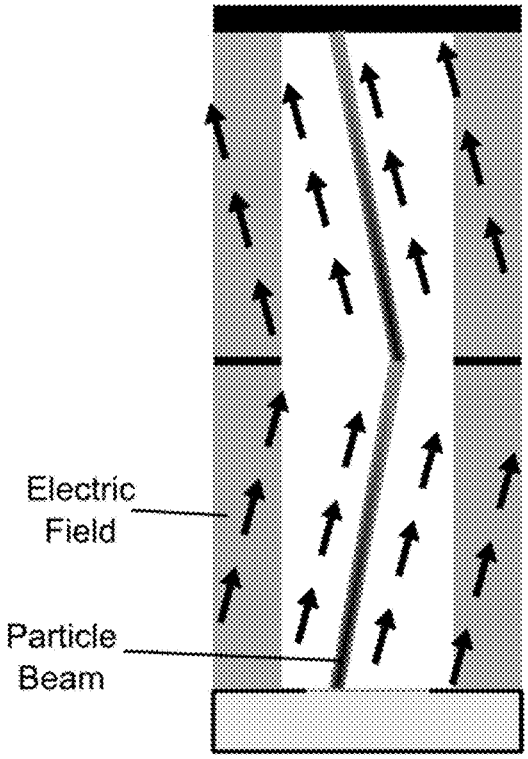

In another embodiment of the invention, a tilted electric field is achieved by changing the crystal rotation of the LN, where the beam does not travel in a straight line down the center of the tubes. Further, several different tubes can be joined end to end, each with successively different rotations. This enables the beam to spiral down the center of the device providing a "tilted field" electrostatic accelerator configuration to approximately double the achievable gradient. This is achieved because electrons that are field-emitted from the accelerator walls are swept away by the tilted field. If the field were parallel to the accelerator walls, the electrons would gain substantial energy and result in a breakdown. In a tilted-field arrangement, only a small amount of energy is gained prior to the electrons being benignly swept away. In the current invention, this feature comes passively. Conversely, in conventional accelerators, such as the cockroft-walton or pelatron, a lot of hardware and complexity is needed to achieve this configuration. FIGS. 8A-8B show serially connected tubes having aligned crystal orientation (8A) and rotated crystal orientations (8B). In one aspect, the crystal-rotated series configuration is capable of establishing a tilted electric field, where an injected beam does not travel in a straight line down the center axis of the hollow tubes, where the hollow tubes are joined end to end having successively different rotations, where the injected beam is induced to spiral along the center of the hollow tube to provide the tilted electric field. In another aspect, a center hollow tube of the concentric hollow tubes is in a vacuum state, where the center hollow tube forms the vacuum envelope, where the outer hollow tubes are capable of being cooled by air or a liquid dielectric.

As described above, a gated ion and/or electron source injects charged particles axially into the accelerator column, which is a stack of piezoelectric hollow cylinders (tubes). A separate piezoelectric vibrating disk imparts a CW sinusoidal displacement (~1-5 μm) onto the piezoelectric tube. This displacement excites the first extensional vibration mode of the tube. The stress in the material in-turn induces a large electric field (4 MV in one exemplary embodiment). Charged particles are electrostatically accelerated by this electric field until impacting a target mounted at the end of the tube. Because the frequency is low, the accelerating force is electrostatic.

The sinusoidal displacement induces an electric field that oscillates from positive to negative 4 MV. Because the frequency is low, the accelerating force is electrostatic. Deuterium ions or electrons (for use in, say, X-ray production) can be accelerated. The final energy of the particles is equal to the potential difference over the length of the piezoelectric column. A gated particle source ensures neutron production only occurs when the potential is above a desired threshold, as shown in FIGS. 9A-9B.

Figure 9A:
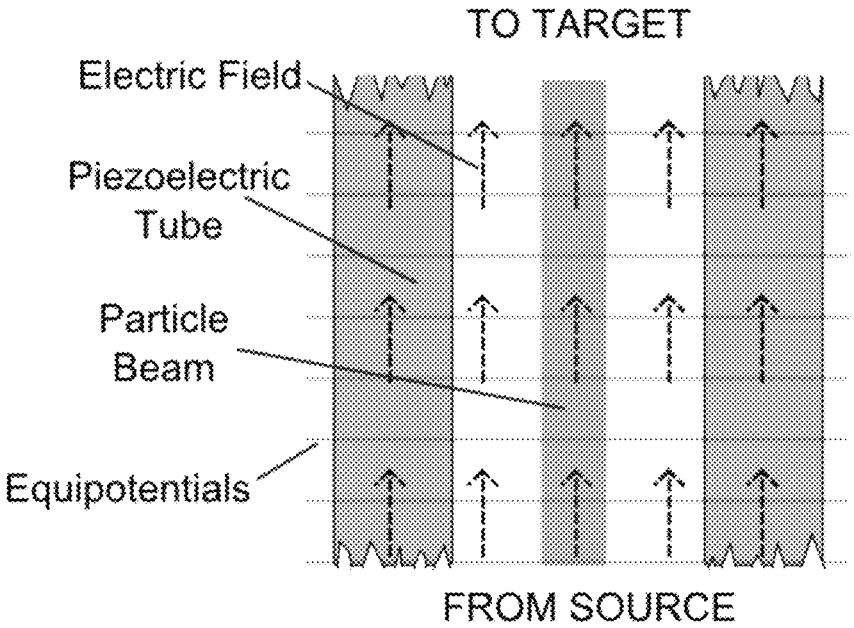
FIGS. 9A-9B show the electrostatic acceleration invention, where (9A) shows a gated ion or electron source injects particles into the acceleration column and the repetition rate is the resonant frequency of the piezoelectric accelerator; (9B) shows the induced electric field in the piezoelectric tube accelerates deuterium ions in the center of the column, according to one embodiment of the invention.
Figure 9B:
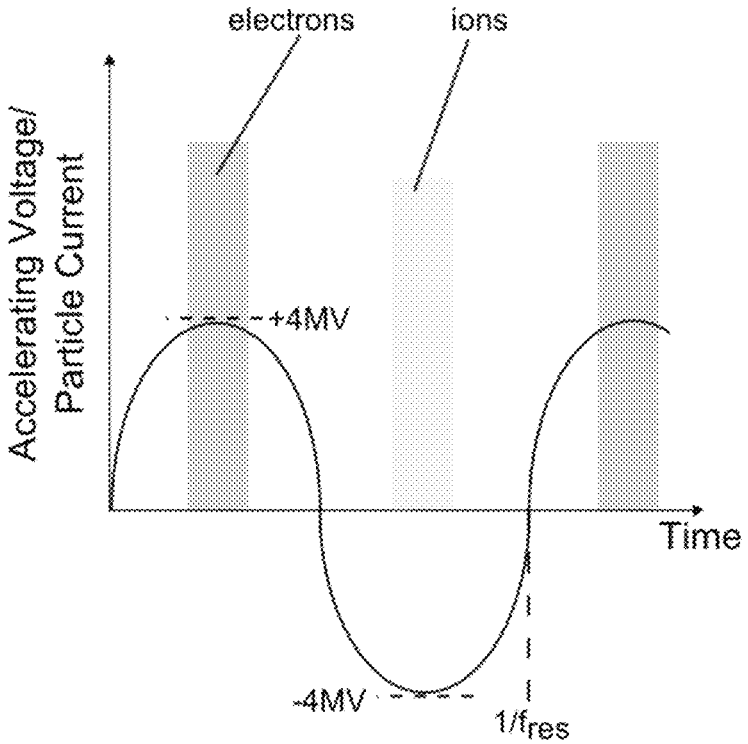

FIGS. 9A-9B show the electrostatic acceleration invention, where (9A) shows a gated ion or electron source injects particles into the acceleration column and the repetition rate is the resonant frequency of the piezoelectric accelerator; (9B) shows the induced electric field in the piezoelectric tube accelerates deuterium ions in the center of the column, according to one embodiment of the invention.

In a further aspect of the invention, the electric field gradient achievable with a piezoelectric, that is (output voltage)/(effective device length), is proportional to the maximum strength of the piezoelectric times the effective piezoelectric constant. If at a given strength and piezoelectric constant, the invention operates in a bipolar mode, for example as a sinusoid oscillating between plus and minus 100 kV, then the device can also operate in a single polarity mode at twice the voltage, for example 0 to 200 kV. This takes advantage of the fact that a DC bias can be placed on the crystal because the electrical conductivity is extremely low in LN, for example. The DC bias can be applied by injecting excess positive or negative charge into the device for a period of time until the desired bias is achieved.

Piezoelectric transformers are traditionally very high output impedance devices; they operate with low output current. Scaling the Rosen-type transformer to higher current means changing the output frequency, and changing the gradient of the device. According to a further aspect of the current invention, changing the cross-sectional area of the tube results in a directly proportional change in the achievable output current. The gradient can remain high, where moving to a very high output current is achieved by increasing the diameter of the tube.

In a further embodiment of the invention, instead of a series stack of tubes, the tubes are nested, with the high voltage tube in the innermost diameter. In this geometry, for a given total length, the required voltage to be produced by any one of the piezoelectric devices decreases. Therefore, the peak stress and power dissipation are reduced. The peak field along the length of the cylinder decreases, reducing the probability of flashover. The outermost cylinder "shields" the high-potential inner cylinder from the grounded chamber wall. Therefore, a much smaller distance from the piezoelectric accelerating column to the chamber wall is made possible.

In a further embodiment of the invention, corona rings reduce the peak electric field in high voltage devices in order to reduce the volume needed to hold off high voltage. In one aspect of the invention, toroids are added in-between tubes to reduce the peak electric field at those junctions, as well as the peak electric field from the tube to the grounded chamber wall. In conventional piezoelectric geometries, these rings or structures may not be added as simply because they would spoil the primary mode of vibration. In the current invention, an extra mode of vibration is not introduced because corona rings are placed close to the center of the tube, and the mass of the corona ring is evenly distributed around the circumference of the device.

According to another aspect, the invention operates in a first length extensional mode, rather than second or higher, which is the highest possible gradient. With respect to Rosen-type and other transformers, they typically operate in modes higher than the first. If they are operated in the second mode, half of the device will be at or very near ground potential. This wastes about half of the device. In tube geometry of the current invention, only a small portion of the device is at ground. Thus, the achievable gradient over conventional approaches is approximately doubled.

In a further embodiment of the invention, the end of the device is mass loaded to even out the stress in the tube to increase the effective gradient.

According to another embodiment of the invention, the target or the ion source is at ground or the high voltage end of the tube.

Other new aspects provided by the invention include the ability to have separate driver rather than a monolithic construction. The crystal rotation can be optimized. High-Q bonding is enabled. A flexible pulse structure width is enabled. And the invention is self-neutralizing.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A particle accelerator comprising:

a) a piezoelectric accelerator element, wherein said piezoelectric accelerator element comprises a hollow cylindrical shape; and b) an input piezoelectric transducer, wherein said input piezoelectric transducer is disposed concentric to a first end of said hollow cylindrical piezoelectric accelerator element and is configured to provide an input signal to said hollow cylindrical piezoelectric accelerator element first end, wherein said input signal at said hollow cylindrical piezoelectric accelerator element first end induces a mechanical excitation along said hollow cylindrical piezoelectric accelerator element, wherein said mechanical excitation is capable of generating a piezoelectric electric field proximal to an axis of said cylindrical shape, wherein said piezoelectric accelerator is configured to accelerate a charged particle that is input to said first end of said hollow cylindrical piezoelectric accelerator element longitudinally along said axis of said cylindrical shape according to said piezoelectric electric field.

2. The particle accelerator according to claim 1, wherein said piezoelectric accelerator element comprises a material selected from the group consisting of Lithium Niobate, Lithium Tantalate, Quartz, and Lead Zirconate Titanate.

3. The particle accelerator according to claim 1, wherein said piezoelectric accelerator element comprises a plurality of said hollow tubes, wherein said plurality of hollow tubes are configured in an arrangement selected from the group consisting of a monolithic, single hollow tube, a series connection of hollow tubes, a concentric arrangement of nested hollow tubes, and a concentric arrangement of solid rods.

4. The particle accelerator according to claim 3, wherein said crystal-rotated series configuration is capable of establishing a tilted electric field, wherein an injected beam does not travel in a straight line down said center axis of said hollow tubes, wherein said hollow tubes are joined end to end having successively different rotations, wherein said injected beam is induced to spiral along said center of said hollow tube to provide said tilted electric field.

5. The particle accelerator according to claim 3, wherein a center hollow tube of said concentric hollow tubes is in a vacuum state, wherein said center hollow tube forms the vacuum envelope, wherein outer said hollow tubes are capable of being cooled by air or a liquid dielectric.

6. The particle accelerator according to claim 1, wherein said input piezoelectric transducer comprises a piezoelectric transducer disk disposed on one end of said piezoelectric accelerator element, wherein said piezoelectric transducer disk is disposed to impart a displacement onto said piezoelectric tube, wherein said displacement is capable of exciting a first extensional vibration mode of said piezoelectric accelerator element, wherein a stress in the material of said piezoelectric accelerator element induces an electric field that is disposed to electrostatically accelerated a charged particle.

7. The particle accelerator according to claim 6, wherein said displacement comprises a CW sinusoidal displacement.

8. The particle accelerator according to claim 7, wherein said CW sinusoidal displacement is in a range of 1-20 μm.

9. The particle accelerator according to claim 6, wherein said induced electric field has a field strength in a range of 0 to 4 MV/m.

10. The particle accelerator according to claim 6 further comprises a target mounted at the end of said piezoelectric accelerator element, wherein said charged particle is electrostatically accelerated by said electric field until impacting said target mounted at the end of said piezoelectric accelerator element.

11. The particle accelerator according to claim 1, wherein said charged particle is selected from the group consisting of protons, deuterium ions, tritium ions, electrons, and charged particles that are heavier than said electrons.

12. The particle accelerator according to claim 1, wherein electric field lines are proximally parallel with said axis of said hollow tube, wherein an injected beam is accelerated down said hollow tube.

13. The particle accelerator according to claim 1, wherein said piezoelectric accelerating element is disposed to operate in a bipolar mode or a single polarity mode.

14. The particle accelerator according to claim 1, wherein an end of said piezoelectric accelerator is mass loaded, wherein said mass loading is disposed to equalize the stress in said hallow tube to increase an effective gradient.

15. The particle accelerator according to claim 1, wherein a target or an ion source is at ground or high voltage.

* * * * *